US005715933A

United States Patent [19]

Monahan

[11] Patent Number: 5,715,933

[45] Date of Patent: Feb. 10, 1998

[54] PALETTE TRANSPORT SYSTEM

[76] Inventor: William P. Monahan, 5809 W. Del Lago Cir., Glendale, Ariz. 85308

[21] Appl. No.: 558,819

[22] Filed: Nov. 16, 1995

[51] Int. Cl.[6] ..... B05C 17/00

[52] U.S. Cl. ..... 206/1.7; 206/518

[58] Field of Search ..... 206/1.7, 1.8, 1.9, 206/205, 518, 515, 519

[56] References Cited

U.S. PATENT DOCUMENTS

| | | | |
|---|---|---|---|
| 3,233,812 | 2/1966 | Kennedy | 206/518 |
| 3,874,499 | 4/1975 | Barnett, Jr. | 206/1.7 |
| 3,885,843 | 5/1975 | Rubel | 206/1.7 |
| 4,321,997 | 3/1982 | Miller | 312/31.05 |
| 4,471,880 | 9/1984 | Taylor et al. | 220/306 |
| 4,512,493 | 4/1985 | Von Holdt | 220/306 |
| 4,638,909 | 1/1987 | Ford | 206/1.7 |
| 5,409,126 | 4/1995 | DeMars | 220/4.27 |
| 5,535,913 | 7/1996 | Asbach et al. | 220/263 |

*Primary Examiner*—Paul T. Sewell
*Assistant Examiner*—Nhan T. Lam
*Attorney, Agent, or Firm*—Martin L. Stoneman

[57] ABSTRACT

An improved palette transport system is provided. More particularly, a palette transport system is provided whereby multiple artist's palettes may be efficiently stored or transported, and without fast drying of the paints on the palettes. A system of open-top boxes which may be stacked in an air-tight manner is disclosed, in which each box may carry a water source and a water-permeable paper sheet to support paint dabs.

17 Claims, 3 Drawing Sheets

16
33

33
15

16
15
26
14

16
34
14
18
16
35
18
14

14b
14
14b
18
14a
18
13
14
14a

PALETTE TRANSPORT SYSTEM

BACKGROUND OF THE INVENTION

1. Field of the Invention

This invention relates to providing an improved palette transport system for artists. More particularly, this invention concerns providing a palette transport system whereby multiple artist's palettes may be efficiently transported, and without fast drying of the paint on the palette.

2 . Description of the Prior Art

In the prior art, there have been attempts to keep palette paint dabs from drying in between times that the palette is used. Although it is often helpful to keep oil paint palette dabs from drying in air between uses, it is especially important to keep acrylic-type paint dabs on palettes from drying out. Acrylic-type paints are water-based emulsions, and when such emulsions dry, they are insoluble and cannot be painted with; even brushes which are coated with dried acrylics must usually be thrown out. An example of a prior art palette system for keeping paints, especially acrylics, from dehydration is described in U.S. Pat. No. 3,804,030, which shows a palette base overlaid by a water-retentive layer, e.g., a sponge-like material, and, on top of that, a layer of disposable porous material, e.g., a sheet of paper, to carry dabs of paint (the paper acting as a palette surface) and promote the continuing hydration, slowing down drying, of such paint dabs while the artist is working. Further shown therein is the placing of a "sleeve" over the artist's palette when the artist is not working to further slow dehydration.

Generally, while the artist may use a great variety of differing materials and methods to produce the art, there are certain mediums and methods of use that have been developed over a long period of time and which are common throughout the art world. This past century has seen the development of polymer colors which have quickly become a favorite of the painter. More specifically, acrylic polymer emulsion paints (often called "acrylics") are pigments utilizing an acrylic polymer as a binder and wherein the vehicle is an emulsion of acrylic resin particles suspended in water. The drying process takes place as the water evaporates, changing the paints from water soluble while wet to insoluble after drying. Being quick drying, such paints present the artist with the task of maintaining usable consistency and prolonging drying until the painting is accomplished. The palette surface frequently used with acrylic paints is a paper, coated to prevent absorption, and furnished in a tablet form. As the artist devotes very much time to preparing and maintaining the palette, its longevity is a major concern. In addition, protecting the wet-paint palette from being contaminated by foreign items while not being attended to (airborne particles, insects, leaves, children, etc.) and preventing the wet paints from accidently getting on unwanted surfaces or items requires some means of protection. A student returning from a painting session at an art class will deal with the challenge of transporting armfuls of painting supplies without getting paints on clothing, auto upholstery, etc., particularly when carrying more than one palette.

Among the needs not met in the prior art are (1) the need to have a convenient way to transport more than one palette at a time; (2) the need to maintain paint condition on such multiple palettes during such transport and non-use; (3) the need to protect such multiple palettes from contamination during non-use periods; (4) the need to protect surrounding articles when transporting painting supplies and palettes; (5) the need to prevent brushes and other painting supplies from drying out during such transport and non-use; and (6) the need to fulfill all these mentioned needs in a manner which is efficient and inexpensive.

OBJECTS OF THE INVENTION

A primary object of the present invention is to fulfill the above-mentioned needs by the provision of an improved system for transport of multiple palettes, including associated supplies when desired. A further primary object of the present invention is to provide an improved method of making such transport system. Another object is to provide such palette transport system which is efficient and inexpensive. Other objects of this invention will become apparent with reference to the following invention descriptions.

SUMMARY OF THE INVENTION

According to a highly-preferred embodiment of the present invention, this invention provides a palette transport system for upright transport of stacked multiple palette means for holding dabs of paint, comprising, in combination: lower and upper open-top box means; in each such open-top box means, palette means for supporting at least one such dab of paint; and sealing means for essentially-air-tight sealing of such palette means in such lower open-top box means when such upper open-top box means firmly abuts from above such lower open-top box means. Further provided is such palette transport system wherein each such palette means is moisture-permeable. Even further provided is such palette transport system wherein each such palette means comprises a sheet of paper-type material. Also provided by this invention is such palette transport system further comprising, in each such open-top box means, below such palette means, liquid-source means for providing moisture. Yet further provided is such palette transport system further comprising, in each such open-top box means, below such palette means, water-source means for providing moisture. And even further, this invention provides such palette transport system wherein such water-source means for providing moisture comprises a sheet of sponge-type material.

Additionally, according to such preferred embodiment of the present invention, there is provided such palette transport system wherein each such open-top box means comprises wall means having upper portions and lower portions, and such sealing means comprises abutment of such upper portions of such wall means of such lower open-top box means against such lower portions of such wall means of such upper open-top box means. Also provided by this invention is such palette transport system further comprising a third such open-top box means, and, within such third such open-top box means, painting supplies.

Yet even further, according to such preferred embodiment of the present invention, there is provided a palette transport system for upright transport of stacked multiple palette means for holding dabs of acrylic-type paint, comprising, in combination: box means for holding water-source means for providing moisture and moisture-permeable palette means for supporting at least one such dab of acrylic-type paint, wherein such box means comprises substantially-vertical internal wall means having a wall height at least as high as the total of the height of such water-source means, the height of such moisture-permeable palette means, the maximum height of an ordinarily-useful such dab of acrylic-type paint, and a clearance distance for ensuring, during a such transport, no presence of such acrylic-type paint as high as such wall height; vertical-stacking means for releasably holding an other such box means in a position above such internal wall means of such (first) box means; and sealing means for moisture-sealing such box means when a such other box means is being releasably held in such position.

And further this invention provides such palette transport system wherein: such box means comprises an open-top, essentially-rectangular box having an inner bottom; and such water-source means for providing moisture comprises an essentially-rectangular sheet of sponge-type material fitting essentially onto such inner bottom of such box and having an upper surface; and such moisture-permeable palette means comprises an essentially-rectangular sheet of paper-type material fitting essentially onto such upper surface of such sheet of sponge-type material. Further provided is such palette transport system wherein such vertical-stacking means comprises, atop such internal wall means, ledge means for supporting such other box means. Even further, this invention provides such palette transport system wherein: such box means comprises substantially-vertical external wall means generally co-extensive with such internal wall means, and, above such ledge means, substantially-vertical second internal wall means; and such sealing means comprises, when a such other box means is being releasably held in such position, an interference fit between such external wall means of such other box means and such second internal wall means of such box means.

Even additionally, according to a preferred embodiment of the present invention, there is provided a method of making a palette transport system for upright transport of stacked multiple palette means for holding dabs of acrylic-type paint, comprising, in combination, the steps of: providing identical lower and upper open-top box means, each having sealing means for essentially-air-tight sealing of such lower open-top box means when such upper open-top box means firmly abuts from above such lower open-top box means; providing a first and second water-source means; providing a first and second moisture-permeable palette means; wetting such first and second water-source means; wetting such first and second moisture-permeable palette means; placing such first water-source means in such lower open-top box means; placing such second water-source means in such upper open-top box means; placing such first moisture-permeable palette means in such lower open-top box means atop such first water-source means; placing such second moisture-permeable palette means in such upper open-top box means atop such second water-source means; and sealing such lower open-top box means in an essentially-air-tight manner by firmly abutting from above such upper open-top box means against such lower open-top box means.

Even further provided, according to this invention, is such method further comprising the step of placing at least one dab of acrylic-type paint on such first moisture-permeable palette means before such sealing step. Also provided is such method further comprising the step of releasing such sealing of such lower open-top box means by removing such upper open-top box means from a position of abutting from above such lower open-top box means. Yet further provided is such method further comprising the steps of: providing a third open-top box means identical to such upper and lower open-top box means; and sealing such upper open-top box means in an essentially-air-tight manner by firmly abutting from above such third open-top box means against such upper open-top box means. Further, this invention provides such method further comprising the steps of: providing a third open-top box means identical to such upper and lower open-top box means; and sealing such third open-top box means in an essentially-air-tight manner by firmly abutting from above such lower open-top box means against such third open-top box means. And further provided is such method further comprising the step of placing painting supplies into such third open-top box means before the such step of sealing such third open-top box means.

DETAILED DESCRIPTION OF A PREFERRED EMBODIMENT AND THE BEST MODE OF PRACTICE

Figure 1:
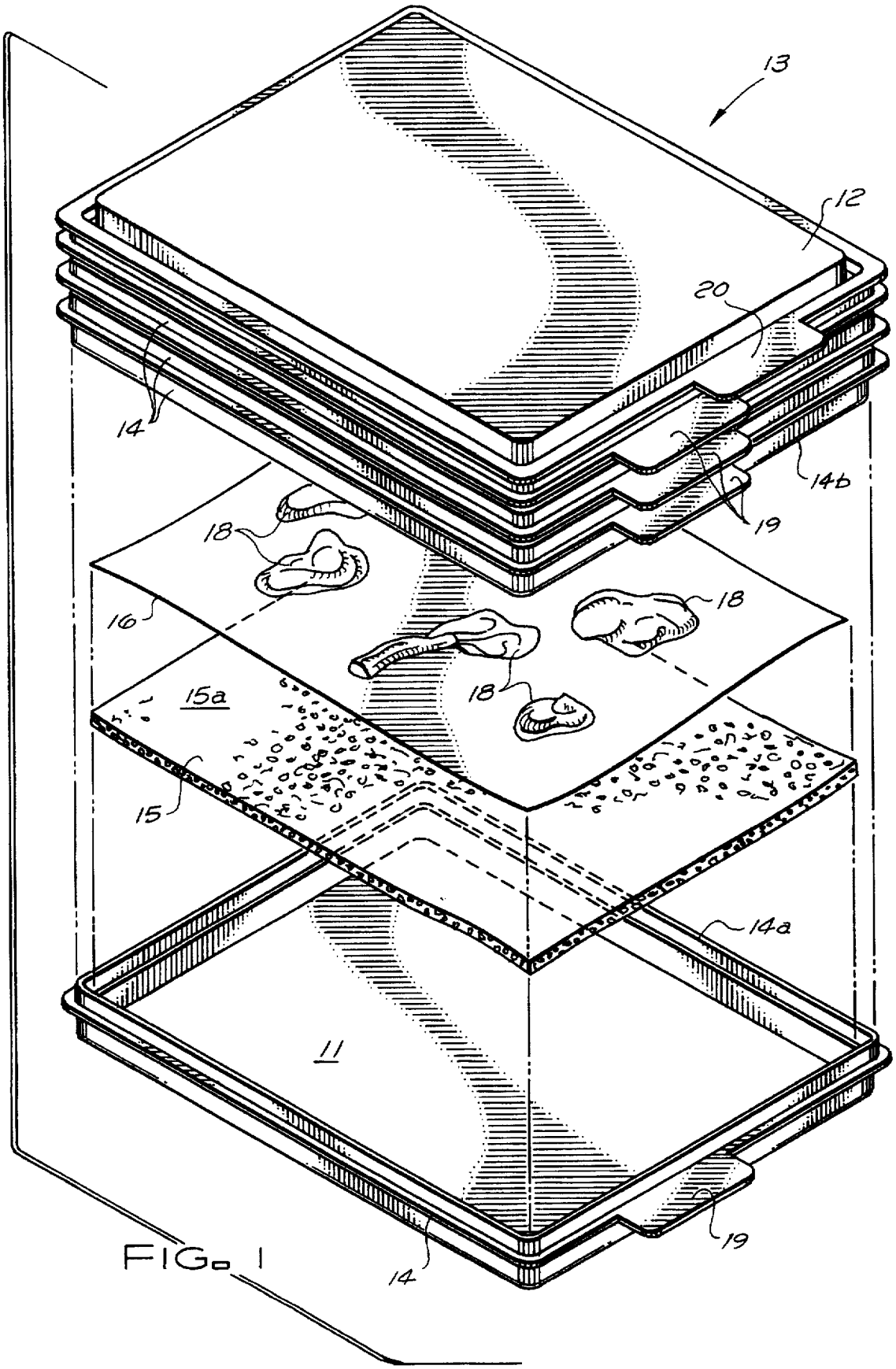
FIG. 1 is a perspective view illustrating the preferred embodiment of multiple stackable palette units, showing contents, and stacked.

In FIG. 1 is shown a perspective view of the preferred embodiment of the stacked multiple palette means (with some contents) of the present invention, embodied by a stack of palette units 13, each such unit being embodied by a stackable open-top box or container 14, with a lid 12 installed on the top stackable box 14. The stackable box 14 is a container used by artists to house a palette means embodied by a moisture-permeable sheet, paper sheet 16, capable of supporting dabs or puddles of artists' paints while they are being prepared and used, while they are transported between uses, and also while being stored between uses. The stackable box 14 is primarily intended to be used with artists' acrylic paints but has advantages with and may be used with other water-based paints as well as artists' oil paints.

Illustrated (FIG. 1) in the stack of palette units 13 are multiple stackable boxes 14 and liquid source means for providing moisture, embodied by an essentially-rectangular sheet of sponge-type material, sponge pad 15, fitting essentially onto the inner bottom surface 11 of stackable box 14, specifically illustrated as a lower stackable box **14*a*. Sponge pad 15 has an upper surface 15*a*. Paper sheet 16 lies atop upper surface 15*a* of sponge pad 15. An upper stackable box 14*b* lies above lower stackable box 14*a* and acts as a lid to make an air-tight seal when firmly abutting lower stackable box 14*a*, as more specifically described hereinafter. The paint dabs 18 supported on the paper sheet 16 are commonly referred to by the artist as the "artist's palette". The paper sheet 16 is kept moist by water which is absorbed into the sponge pad 15 prior to placement thereon of paper sheet 16. In addition, the paper sheet 16 is soaked in water prior to use to provide a more suitable surface for containing the paint. The paper sheet 16** is preferably, for use with acrylics, a paper sheet which is laced with latex, and such a paper sheet is currently commercially available from Masterson Art Products, Inc., as No. 857 Acrylic Palette Film (and a sponge pad of the type herein described comes with each 40 paper sheets from said company).

When the stack of palette units 13 are assembled and sealed (with lid 12 on the very uppermost box 14), air-tight containers are provided with proper humidity to prevent the paints 18 from drying out for a convenient length of time. Each stackable box 14 has a tab 19 and lid 12 has a tab 20 (which may be offset for ease of use in separating parts). It is noted that any stackable box 14 of the illustrated stack of palette units 13 may be used to store paint supplies of proper size (not shown), such as wet paint brushes, so that such supplies may not only be protected from drying out but may also be transported more efficiently.

Figure 2:
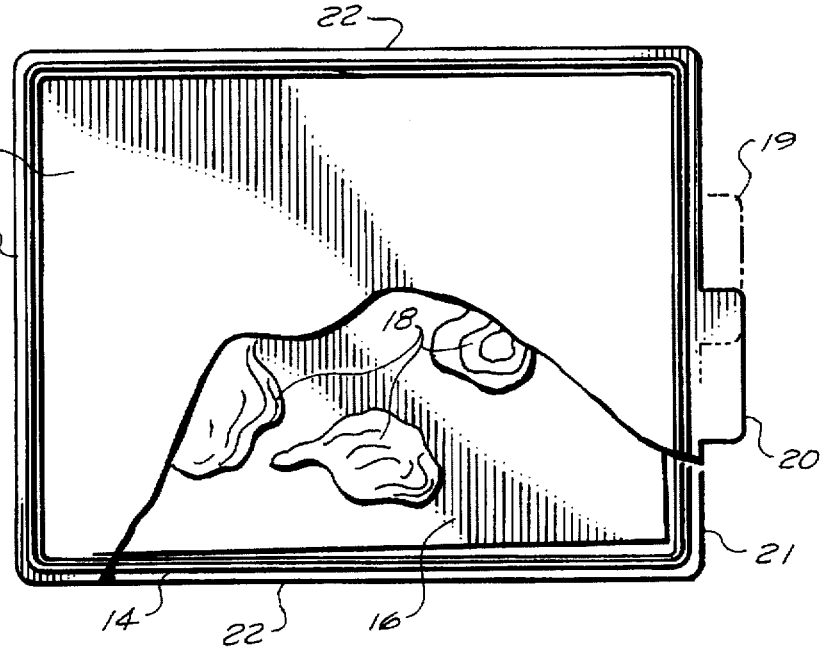
FIG. 2 is a top plan view, partially cut-away, of the preferred embodiment of a stackable palette unit (and showing a cover for use with the uppermost stackable palette unit).

FIG. 2 is a top plan view, partially cut-away, of the preferred embodiment of an uppermost stackable box 14 with lid 12 installed. Vertical spacing between stacked stackable boxes 14 is still ample to insert fingers between their tabs 19 to provide leverage to loosen and separate the airtight abutment of the stackable boxes 14. Shown in phantom lines is the position of a tab 19. The vertical distance between a stackable box 14's tab 19 and a lid 12's tab 20 is less and a twisting action using a thumb and forefinger make lid 12 removal easier. The stackable boxes 14 and lid 12 are made of a semi-flexible plastic (in well-known ways) for easier assembly, disassembly and conforming together for a tighter seal. Shown under the cut-away portion in the top stackable box 14 is the paper sheet 16 and paint dabs 18. As shown, the stackable boxes 14 preferably have a short side 21 and a long side 22 forming an interior bed with dimensions (e.g., about nine inches by about seven inches) compatible with the needs of a typical artist.

Figure 3:
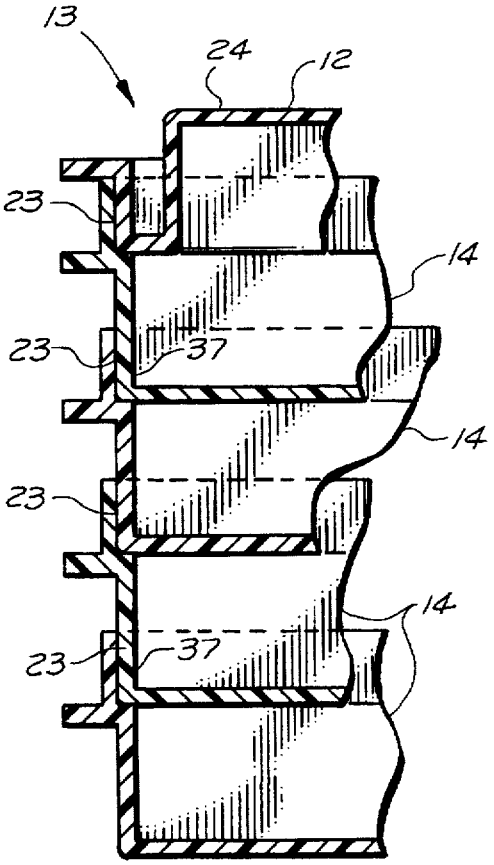
FIG. 3 is a partial cross-sectional elevation view of a stack of palette units (without contents).

FIG. 3 is a partial cross-sectional elevation view of a stack of palette units 13, in which the contents of stackable boxes 14, for clarity, are not shown. Four stackable boxes 14 and one lid 12 are fitted together to make four air tight compartments. Each stackable box 14 inserts snugly within a lower stackable box 14 making an air tight seal at sealing location 23 which continues completely around the perimeter. Each stackable box 14 (except for the bottom-most) provides the cover for the next below stackable box 14. The lid 12 with a raised top 24 provides a top compartment with greater depth than those below.

Figure 4:
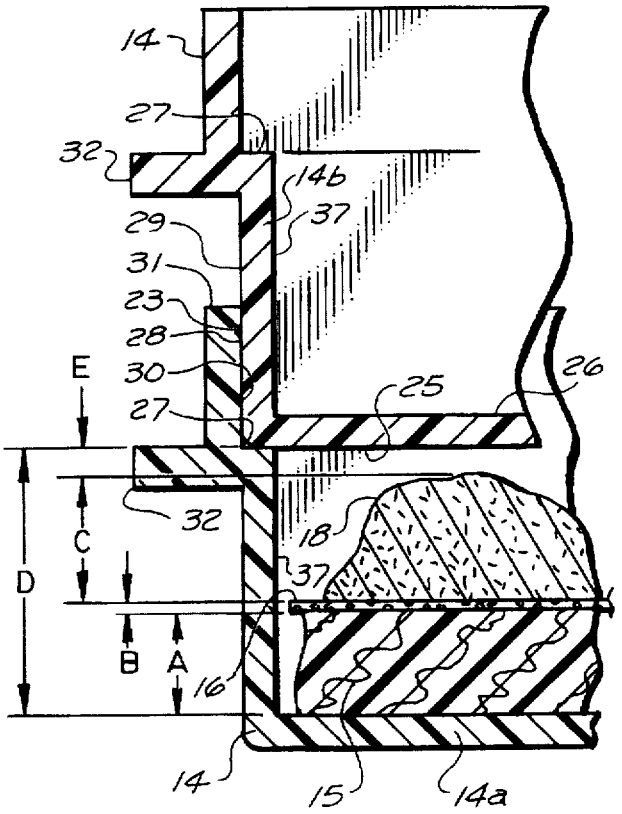
FIG. 4 is an enlarged partial cross-sectional elevation view of two stackable palette units with contents.

FIG. 4 is an enlarged cross-sectional elevation view of two stackable boxes 14 with contents of lower box **14*a* consisting of a sponge pad 15, and a paper sheet 16, supporting a paint dab 18. The stacking depth D provides for a nominal clearance E above the paint dab 18. The stacking depth D will equal the height of the substantially-vertical internal wall means 37 of the lower wall portions, i.e., lower side wall 29, of stackable box 14. The stacking depth D, as shown, preferably equals the total of the thickness or height A of sponge pad 15 plus the thickness or height B of paper sheet 16 plus the maximum height C of an ordinarily-useful dab 18 of, say, acrylic-type paint plus a clearance distance E for ensuring, during a transport of a stack of palette units 13, no presence of paint as high as the underside 25 of upper box 14*b*. Thus a preferred nominal clearance E may be established to prevent a typical mound of paint, e.g. dab 18, from contacting the underside 25 of the bottom 26 of upper stackable box 14*b* while minimizing the volume of air within the sealed compartment. The minimum quantity of air space prolongs the length of time the paint dab 18** remains wet and usable.

The vertical location of interior ledge 27 determines the stacking depth D, in that, when the upper stackable box **14*b* is fully firmly abutting the lower stackable box 14*a*, the underside 25 of upper box 14*b* bottoms on interior ledge 27. Compartmental sealing takes place at the sealing location 23 between the outer surface 28 of the lower sidewall 29 and the inner surface 30 of the upper wall portions, i.e., the upper sidewall 31, of stackable box 14. These surfaces 28 and 30 at the sealing location 23 are structured to have an interference fit with each other so that their abutment provides an air tight seal (in well known ways). A horizontal flange 32 is provided around the outer perimeter of stackable box 14** to increase rigidity and convenience of handling.

FIGS. 5 through 11 illustrate in perspective views the typical sequence and method of making and usage of the preferred embodiment of a stack of palette units 13, comprising the following steps: As in FIG. 5, immerse in water 33 and soak a paper sheet 16 for approximately 30–45 minutes. As in FIG. 6, hold a sponge pad 15 under a water supply 33 or submerge to fully saturate. Per FIG. 7, place the saturated sponge pad 15 into the bottom 26 of a stackable box 14; and lay the soaked paper sheet 16 (from FIG. 5) on top of the saturated sponge pad 15. Per FIG. 8, with a damp paper towel 34, wipe off the excess water from the paper sheet 16. If water beads on the surface of the paper sheet 16, paper sheet 16 should be further soaked in until beading ceases. The paper sheet 16 surface is now ready to accept paints. As in FIG. 9, dabs of acrylic paints 18 of the desired pigments may be transferred from their container or tube 35 in the necessary quantity to the paper sheet 16. Using a palette knife or other desired method, the artist may then, in well known ways, mix and prepare the paints from dabs 18 for use in painting, and may proceed with a painting session as normal. If the sponge pad 15 and paper sheet 16 start to dry out, lift the paper film 16 and sponge pad 15 slightly at one corner and add a few teaspoons of water. Then gently tip the stackable box 14 to evenly distribute the water under the sponge pad 15. After the painting session has ended, seal the stackable box 14 containing the paint (now lower stackable box **14*a*) with another (upper) stackable box 14*b*, as in FIG. 10, by firmly pressing down on the periphery of the upper box while holding or pressing upwards on the periphery of the lower box until the above-mentioned interference fit is fully seated. As in FIG. 11, this sealing procedure may be repeated with other stackable boxes 14, either below or above those of FIG. 10, with stackable boxes 14 which may or may not contain wet paints, paint supplies, etc. In this manner, the stack of palette units 13 may be comprised also of boxes 14 with mixed paints 18** from other painting sessions and/or "dry" containers containing spare paper sheets and/or "wet" containers containing paint supplies, etc.

Figures 5, 6, 7, 8, 9, 10, 11:
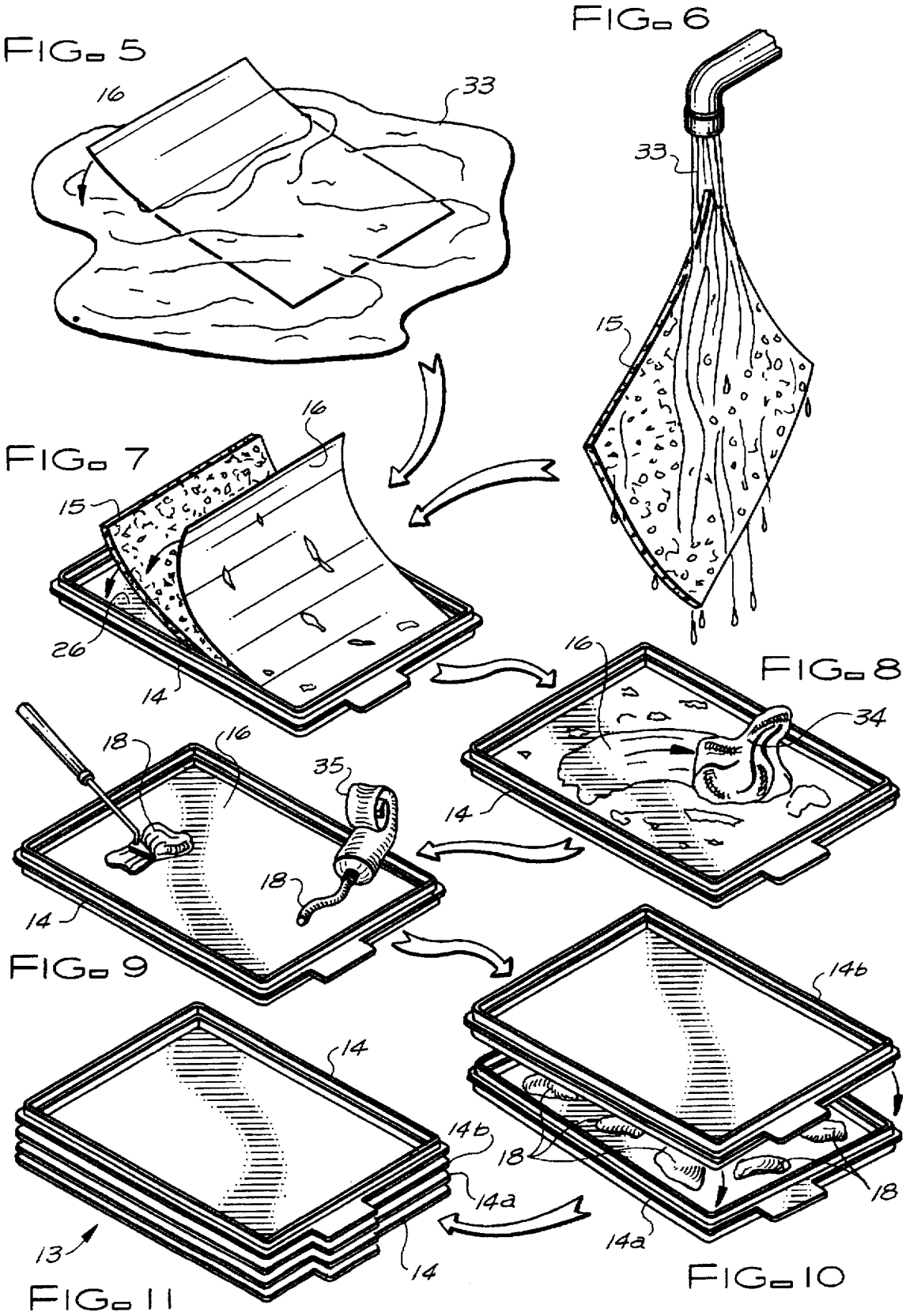
FIGS. 5 through 11 illustrate in perspective views the steps of a preferred method of making and usage of the preferred embodiment of multiple stackable palette units.

As shown in FIG. 11, the combined stack of palette units 13 may conveniently be transported or stored. The stackable boxes 14 may be used to contain other types of water-soluble paints by being prepared and used in the same manner. Additionally, oil based paints may be conveniently stored with drying time extended by eliminating the water 33 and sponge pad 15, and using conventional palette paper specifically suited for oil paints.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A palette transport system for upright transport of stacked multiple palette means for holding dabs of paint, comprising, in combination:

a. lower and upper open-top box structures;

b. in each said open-top box structure, palette means for supporting at least one said dab of paint; and c. sealing means for essentially-air-tight sealing of said palette means in said lower open-top box structure when said upper open-top box structure firmly abuts from above said lower open-top box structure.

2. The palette transport system of claim 1 wherein:

a. each said open-top box structure comprises wall structures having upper portions and lower portions; and b. said sealing means comprises abutment of said upper portions of said wall structures of said lower open-top box means against said lower portions of said wall structures of said upper open-top box structure.

3. The palette transport system of claim 1 further comprising:

a. a third said open-top box structure; and b. within said third said open-top box structure, painting supplies.

4. The palette transport system of claim 1 wherein each said palette means is moisture-permeable.

5. The palette transport system of claim 4 wherein each said palette means comprises a sheet of paper-type material.

6. The palette transport system of claim 4 further comprising:

a. in each said open-top box structure, below said palette means, liquid-source means for providing moisture.

7. The palette transport system of claim 4 wherein each said palette means is water-moisture-permeable.

8. The palette transport system of claim 7 further comprising:

a. in each said open-top box structure, below said palette means, water-source means for providing moisture.

9. The palette transport system of claim 8 wherein said water-source means for providing moisture comprises a sheet of sponge-type material.

10. The palette transport system of claim 8 wherein a. each said open-top box structure comprises wall structures having upper portions and lower portions; and b. said sealing means comprises abutment of said upper portions of said wall structures of said lower open-top box structure against said lower portions of said wall structures of said upper open-top box structure.

11. A palette transport system for upright transport of stacked multiple palette means for holding dabs of acrylic-type paint, comprising, in combination:

a. box means for holding i. water-source means for providing moisture, and ii. moisture-permeable palette means for supporting at least one said dab of acrylic-type paint, b. wherein said box means comprises substantially-vertical internal wall structures having a wall height at least as high as the total of i. the height of said water-source means, ii. the height of said moisture-permeable palette means, iii. the maximum height of an ordinarily-useful said dab of acrylic-type paint, and iv. a clearance distance for ensuring, during a said transport, no presence of said acrylic-type paint as high as said wall height;

c. vertical-stacking means for releasably holding an other said box means in a position above said internal wall structures of said first box means; and d. sealing means for moisture-sealing said first box means when a said other box means is being releasably held in said position;

e. wherein i. said box means comprises an open-top, essentially-rectangular box having an inner bottom; and ii. said water-source means for providing moisture comprises an essentially-rectangular sheet of sponge-type material fitting essentially onto said inner bottom of said box and having an upper surface; and iii. said moisture-permeable palette means comprises an essentially-rectangular sheet of paper-type material fitting essentially onto said upper surface of said sheet of sponge-type material.

12. A method of making a palette transport system for upright transport of stacked multiple palette means for holding dabs of acrylic-type paint, comprising, in combination, the steps of:

a. providing identical lower and upper open-top box structures, each having sealing means for essentially-air-tight sealing of said lower open-top box structure when said upper open-top box structure firmly abuts from above said lower open-top box structure;

b. providing a first and second water-source structures;

c. providing a first and second moisture-permeable palette structure;

d. wetting said first and second water-source structures;

e. wetting said first and second moisture-permeable palette structures;

f. placing said first water-source structure in said lower open-top box structure;

g. placing said second water-source structure in said upper open-top box structure;

h. placing said first moisture-permeable palette structure in said lower open-top box structure atop said first water-source structure;

i. placing said second moisture-permeable palette structure in said upper open-top box structure atop said second water-source structure;

j. sealing said lower open-top box structure in an essentially-air-tight manner by firmly abutting from above said upper open-top box structure against said lower open-top box structure.

13. The method of claim 12 further comprising the step of placing at least one dab of acrylic-type paint on said first moisture-permeable palette structure before said sealing step.

14. The method of claim 12 further comprising the step of releasing said sealing of said lower open-top box structure by removing said upper open-top box structure from a position of abutting from above said lower open-top box structure.

15. The method of claim 12 further comprising the steps of:

a. providing a third open-top box structure identical to said upper and lower open-top box structure; and b. sealing said upper open-top box structure in an essentially-air-tight manner by firmly abutting from above said third open-top box structure against said upper open-top box structure.

16. The method of claim 12 further comprising the steps of:

a. providing a third open-top box structure identical to said upper and lower open-top box structure; and b. sealing said third open-top box structure in an essentially-air-tight manner by firmly abutting from above said lower open-top box structure against said third open-top box structure.

17. The method of claim 16 further comprising the step of placing painting supplies into said third open-top box structure before the said step of sealing said third open-top box structure.

* * * * *